US009893459B2

(12) United States Patent
Zhao et al.

(10) Patent No.: US 9,893,459 B2
(45) Date of Patent: Feb. 13, 2018

(54) ELECTRICAL CONNECTOR HAVING A TONGUE PORTION EXTENDING BEYOND A METALLIC SHELL

(71) Applicant: FOXCONN INTERCONNECT TECHNOLOGY LIMITED, Grand Cayman (KY)

(72) Inventors: Jun Zhao, Huaian (CN); Cai-Yun Zhang, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/484,156

(22) Filed: Apr. 11, 2017

(65) Prior Publication Data

US 2017/0294738 A1 Oct. 12, 2017

(30) Foreign Application Priority Data

Apr. 11, 2016 (CN) ..... 2016 1 0218955

(51) Int. Cl.

| | |
|---|---|
| ***H01R 13/74*** | (2006.01) |
| ***H01R 13/6585*** | (2011.01) |
| ***H01R 13/52*** | (2006.01) |
| ***H01R 24/60*** | (2011.01) |
| *H01R 107/00* | (2006.01) |

(52) U.S. Cl.

CPC ..... *H01R 13/5219* (2013.01); *H01R 13/6585* (2013.01); *H01R 24/60* (2013.01); *H01R 13/74* (2013.01); *H01R 13/745* (2013.01); *H01R 2107/00* (2013.01)

(58) Field of Classification Search

CPC .. H01R 13/74; H01R 13/745; H01R 13/6581; H01R 24/60; H01R 13/6596; H01R 13/6585; H01R 13/743

USPC ..... 439/607.01, 939, 556, 607.55, 559, 745

See application file for complete search history.

(56) References Cited

U.S. PATENT DOCUMENTS

| | | | | |
|---|---|---|---|---|
| 5,277,610 | A * | 1/1994 | Krehbiel | H01R 13/5202 439/271 |
| 9,391,391 | B2 | 7/2016 | Chien | |
| 9,407,049 | B2 * | 8/2016 | Ishibashi | H01R 13/6397 |

(Continued)

FOREIGN PATENT DOCUMENTS

| | | |
|---|---|---|
| CN | 203932465 | 11/2014 |
| CN | 203942083 | 11/2014 |

(Continued)

*Primary Examiner* — Renee Luebke
*Assistant Examiner* — Paul Baillargeon
(74) *Attorney, Agent, or Firm* — Wei Te Chung; Ming Chieh Chang

(57) ABSTRACT

An electrical connector, for mounting to an electrical device which has a mating hole and a stepped portion located at a rear end of the mating hole to form a receiving space therebetween, includes: an insulative housing having a base portion and a tongue portion extending forwardly from the base portion; plural conductive contacts affixed to the insulative housing; a shielding plate affixed to the insulative housing; a shell attached to the insulative housing to form a mating room and adapted for assembling to the receiving space; and a sealer enclosing a front end of the shell and adapted for resisting against the stepped portion; wherein the tongue portion extends out of the mating room and stretches into the mating hole.

17 Claims, 9 Drawing Sheets

(56) References Cited

U.S. PATENT DOCUMENTS

| | | | | |
|---|---|---|---|---|
| 9,429,360 | B2 | 8/2016 | Hsiao | |
| 9,444,177 | B2 | 9/2016 | Tsai | |
| 2015/0244099 | A1 | 8/2015 | Lee | |
| 2015/0295356 | A1* | 10/2015 | Tziviskos | H01R 24/64 439/248 |

FOREIGN PATENT DOCUMENTS

| | | |
|---|---|---|
| CN | 205016762 | 2/2016 |
| CN | 105449434 | 3/2016 |
| TW | M420895 | 1/2012 |

* cited by examiner

ELECTRICAL CONNECTOR HAVING A TONGUE PORTION EXTENDING BEYOND A METALLIC SHELL

BACKGROUND OF THE DISCLOSURE

1. Field of the Disclosure

The present disclosure relates to a waterproof electrical connector.

2. Description of Related Arts

U.S. Pat. No. 9,391,391 discloses an electrical connector including a waterproof rubber ring or sealer at a front end of a metal shell. A tongue portion is received within a receiving room of the metal shell. A length of the metal shell is too long. The sealer engages a flange of the metal shell.

An improved electrical connector is desired.

SUMMARY OF THE DISCLOSURE

Accordingly, an object of the present disclosure is to provide an electrical connector ensuring the waterproof of the electrical connector.

To achieve the above object, an electrical connector, for mounting to an electrical device which has a mating hole and a stepped portion located at a rear end of the mating hole to form a receiving space therebetween, comprises: an insulative housing having a base portion and a tongue portion extending forwardly from the base portion; a plurality of conductive contacts affixed to the insulative housing; a shielding plate affixed to the insulative housing; a shell attached to the insulative housing to form a mating room and adapted for assembling to the receiving space; and a sealer enclosing a front end of the shell and adapted for resisting against the stepped portion; wherein the tongue portion extends out of the mating room and stretches into the mating hole.

Other objects, advantages and novel features of the disclosure will become more apparent from the following detailed description when taken in conjunction with the accompanying drawings.

DETAILED DESCRIPTION OF THE PREFERRED EMBODIMENT

Figure 1:
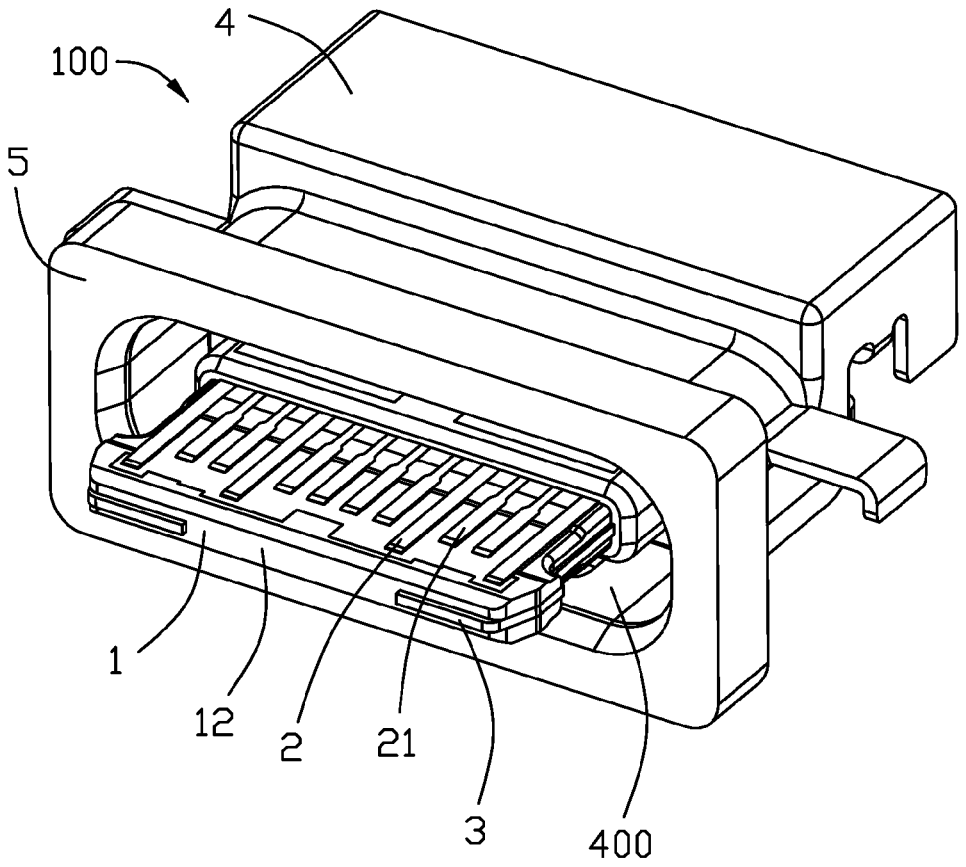
FIG. 1 is a perspective, assembled view of an electrical connector in a first embodiment.
Figure 2:
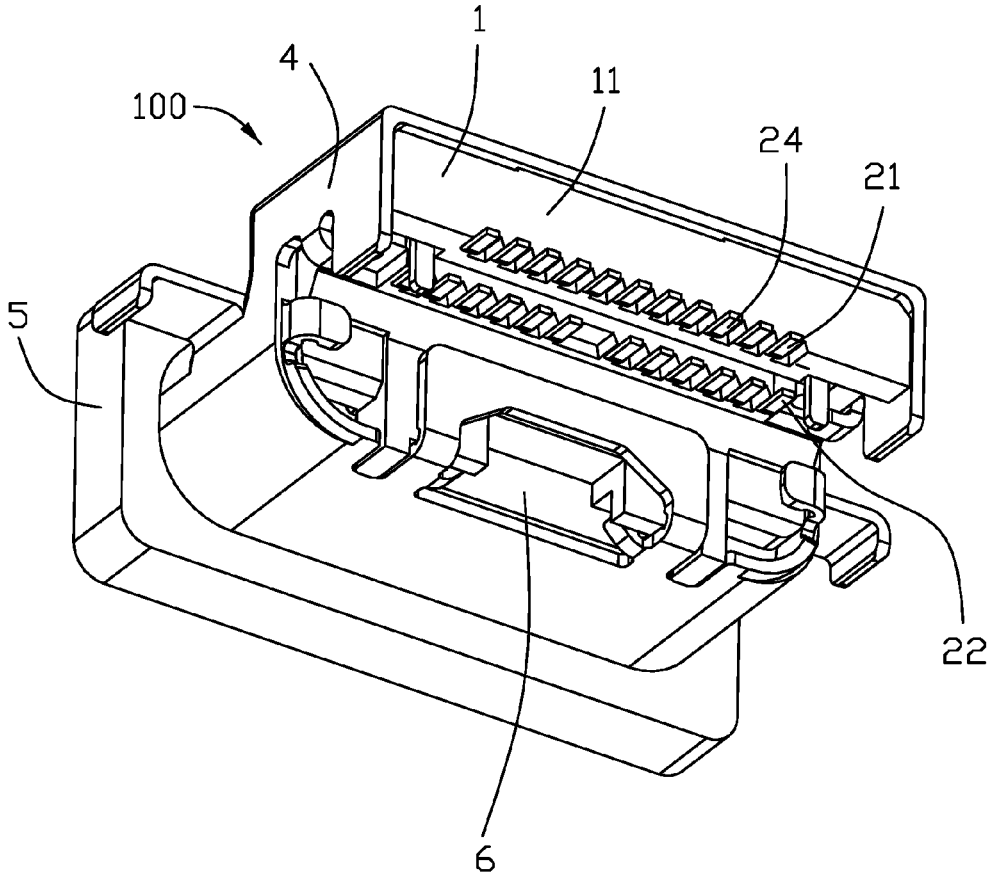
FIG. 2 is another perspective, assembled view of the electrical connector taken from FIG. 1.
Figure 3:
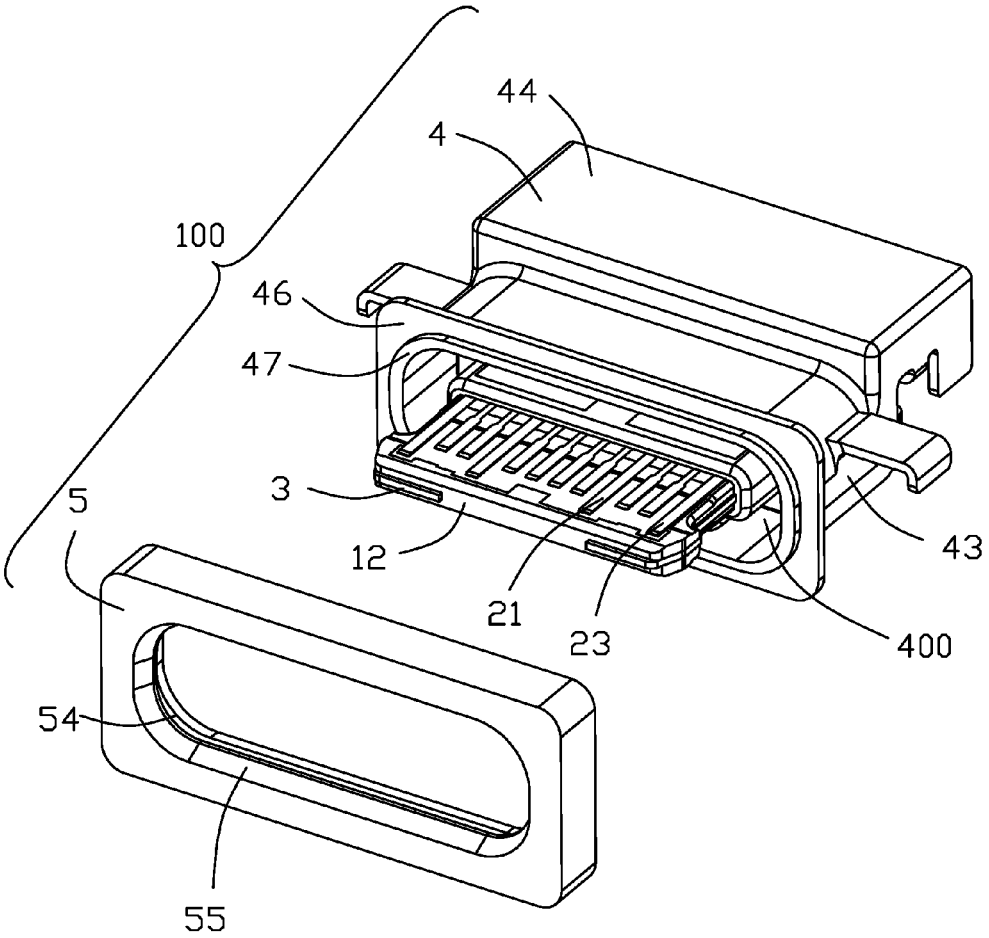
FIG. 3 is an exploded view of a sealer and the other parts of the electrical connector in the first embodiment.
Figure 4:
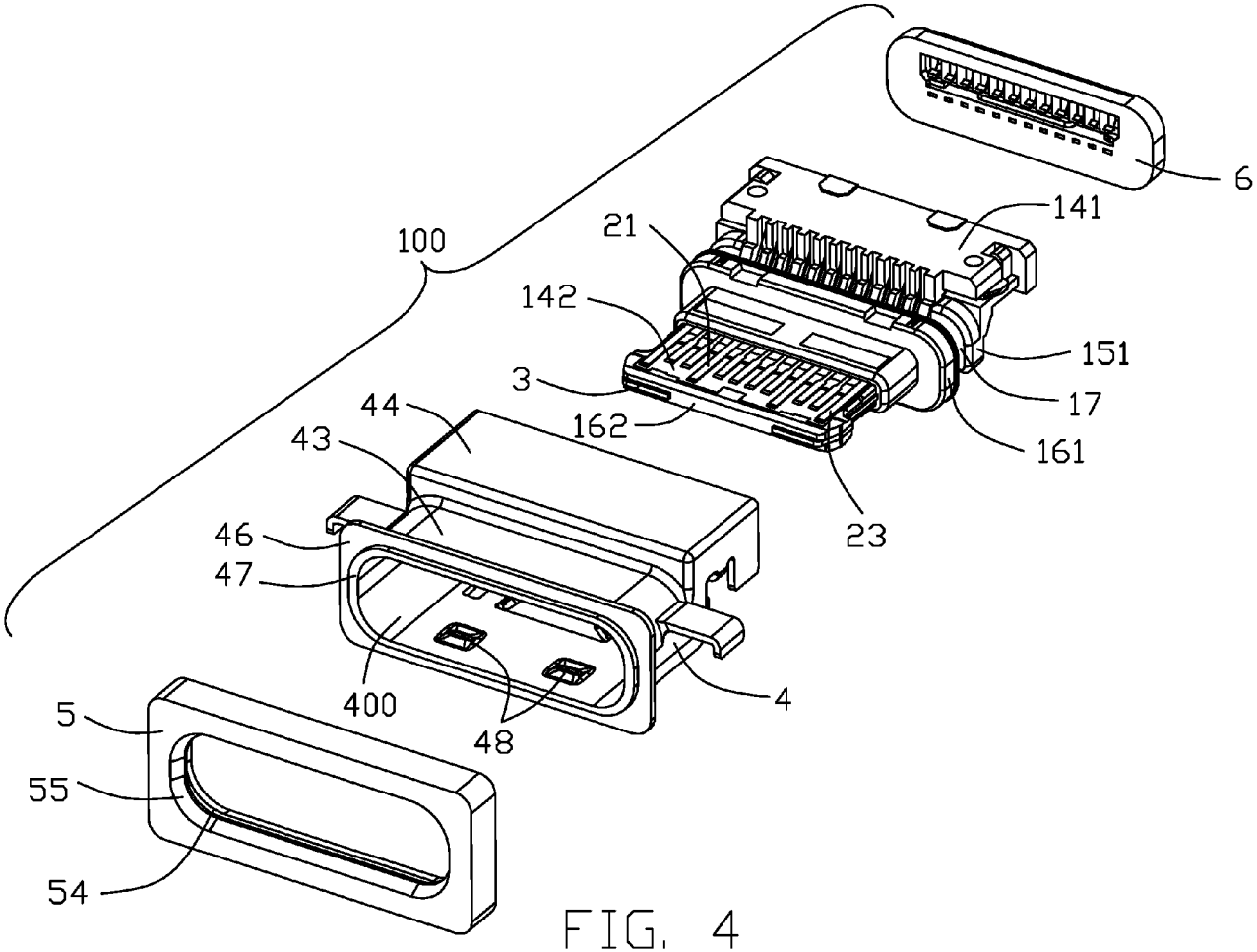
FIG. 4 is a further exploded view of the electrical connector taken from FIG. 3.
Figure 5:
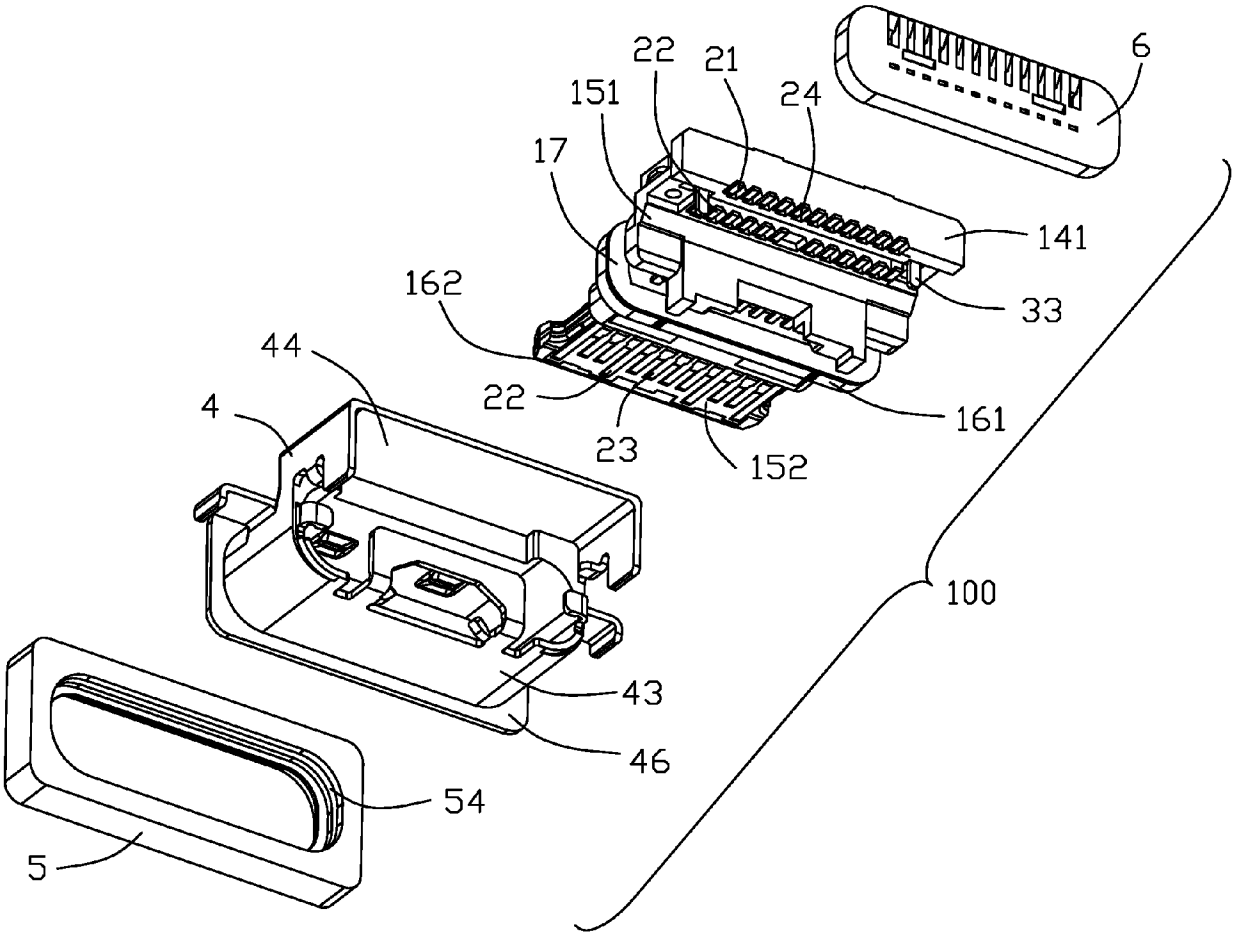
FIG. 5 is another perspective, exploded view of the electrical connector taken from FIG. 4.
Figure 6:
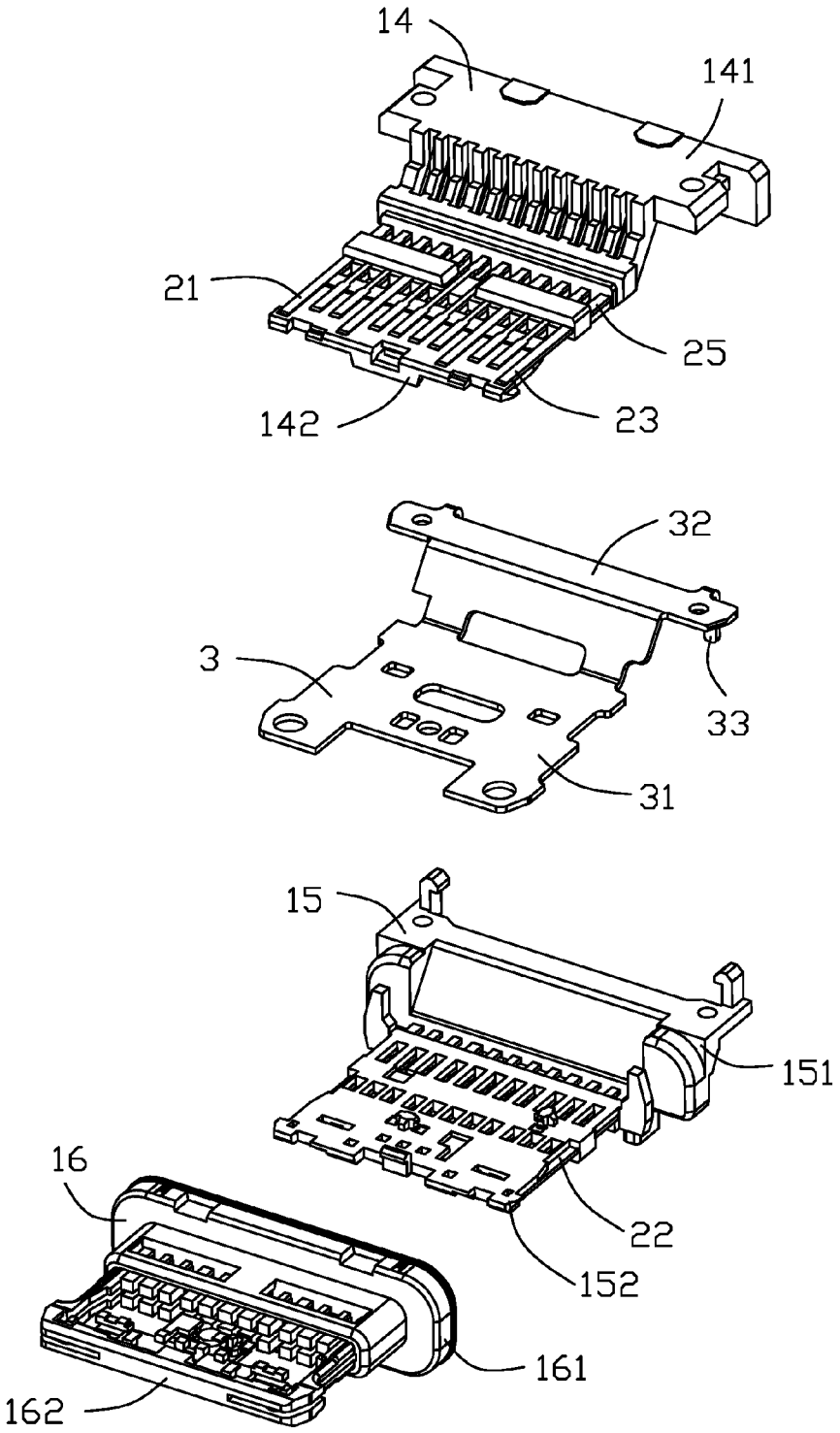
FIG. 6 is an exploded view of an insulative housing, a plurality of conductive contacts and a shielding plate of the electrical connector in the first embodiment.
Figure 7:
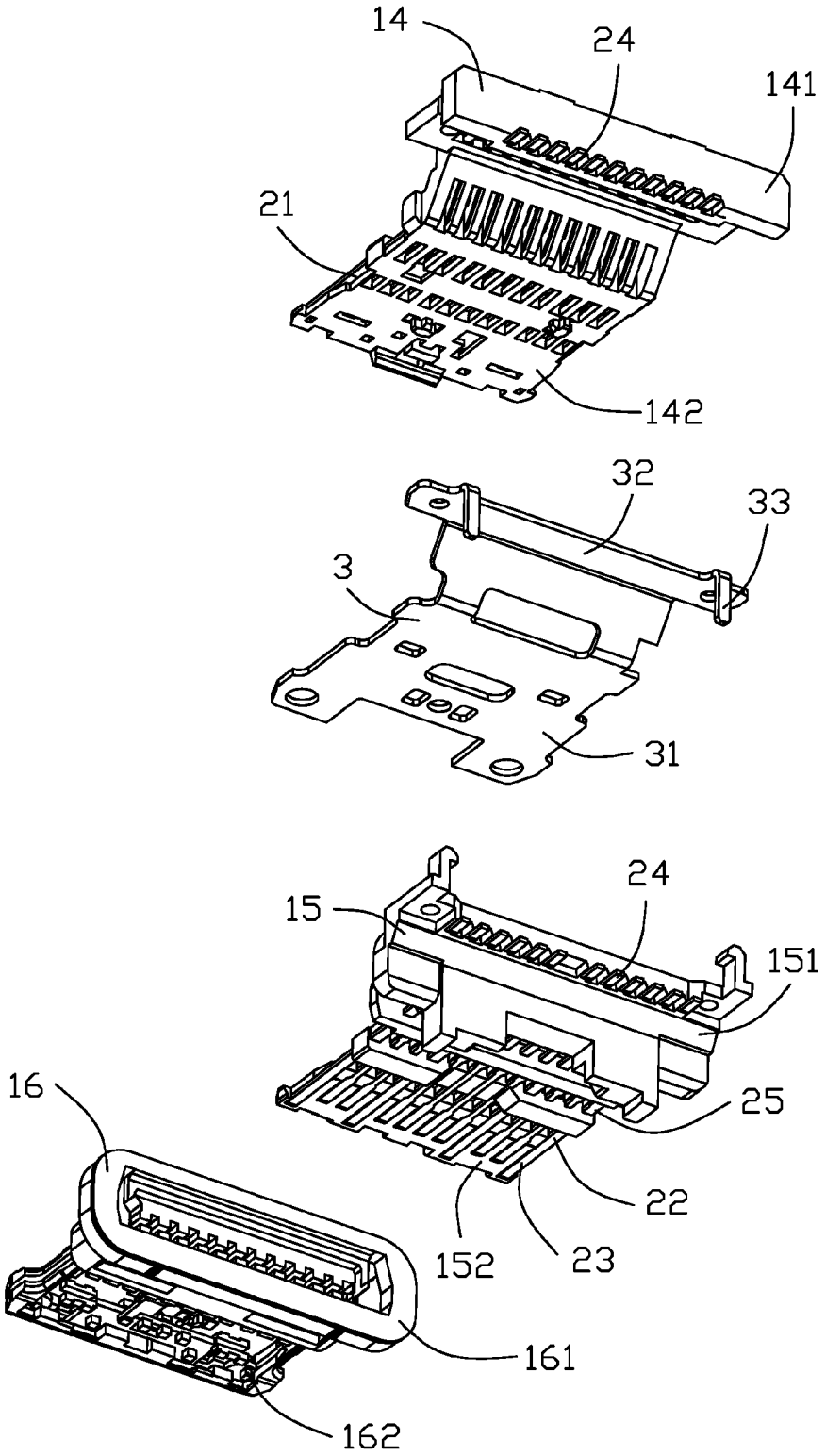
FIG. 7 is another perspective, exploded view of the electrical connector taken from FIG. 6.

Reference will now be made in detail to the first and second embodiments of the present disclosure.

The first embodiment is shown from FIGS. 1 to 8. The second embodiment is shown in FIG. 9. Referring to FIGS. 1 to 9, an electrical connector 100 (100') of the present disclosure is connected with a printed circuit board. The electrical connector 100 (100') is mounted to an electrical device 700 (700') including a wall (not labeled) with a mating hole 71 (71'), a pair of receiving spaces 73 (73') around the interior face (not labeled) of the wall (not labeled), and a stepped portion 72(72') formed between the mating hole 71(71') and the receiving spaces 73 (73'). The electrical connector 100 (100') is connected with the corresponded connector by the mating hole 100(100').

Referring to FIGS. 1 to 8, the electrical connector 100 in the first embodiment includes an insulative housing 1, a number of conductive contacts 2 affixed to the insulative housing 1, a shielding plate 3 affixed to the insulative housing 1, and a shell enclosing the insulative housing 1.

The insulative housing 1 includes a base portion 11 and a tongue portion 12 extending forwardly from the base portion 11. The insulative housing 1 further includes an upper module 14, a lower module 15, and an insulator 16 overlapping the upper module 14 and the lower module 15. The upper module 14 includes a first base portion 141, and a first tongue portion 142 extending forwardly from the first base portion 141. The lower module 15 includes a second base portion 151 and a second tongue portion 152 extending forwardly from the second base portion 151. The insulator 16 includes a third base portion 161 and a third tongue portion 162 extending forwardly from the third base portion 161. The lower module 15 is assembled to the upper module 14 in a vertical direction and located below the upper module 14. The first base portion 141, the second base portion 151, and the third base portion 161 form the base portion 11. The first tongue portion 142, the second tongue portion 152 and the third tongue portion 162 forms the tongue portion The upper module 14, the lower module 15 and the insulator 16 are injection molded to forms the insulative housing 1. Referring to FIGS. 1 to 8, the insulative housing 1 further includes a circle channel 17 located at the base portion 11. The circle channel 17 is formed around a rear end of the first base portion 141, a rear end of the second base portion 151, and a rear end of the third base portion 161.

Referring to FIGS. 1 to 8, each conductive contact 2 includes a contacting portion 23, a soldering portion 24, and a fixing portion 25 connecting the contacting portion 23 and the soldering portion 24. The conductive contacts 2 include a number of upper terminals 21 affixed to the upper module 14 and a number of lower terminals 22 affixed to the lower module 15. The contacting portions 23 of the lower terminals 22 are exposed to a lower surface of the second tongue portion 152. The soldering portions 24 of the lower terminals 22 protrude out of the second base portion 151 and extend rearward. Each of the upper terminals 21 is associated with a respective one of the lower terminals 22 and is positioned in reverse symmetry with respect to the lower terminals 22. The soldering portions 24 of the upper terminals 21 and the lower terminals 22 are located in the same plane and arranged in two rows in a transverse direction perpendicular to the vertical direction. The soldering portions 24 of the upper terminals 21 are staggered to the soldering portions 24 of the lower terminals 22 in an inserting direction perpendicular to the vertical direction and the transverse direction making it easy for the electrical connector 100 to solder to the PCB.

Referring again to FIGS. 1 to 8, the shielding plate 3 includes a main portion 31, a board portion 32, and a pair of soldering pins 33 extending from the board portion 32 and bent downwardly.

The upper module 14 with the upper terminals 21, the lower module 15 with the lower terminals 22, and the shielding plate 3 form an insulative module.

Referring to FIGS. 1 to 5 and FIG. 8, the shell includes a shielding shell 4 and a sealer 5.

The shielding shell 4 includes a main body 43 and a rear portion 44 extending rearward from the main body 43. The main body 43 encloses the insulative housing 1 to form a mating room 400. The main body 43 further includes a circle convex portion or circumferential outward protrusion 46 on an outer surface of a front end of the main body 43, a front edge 47 located at an opening of the mating room 400 and in front of the circle convex portion 46 and four tubers 48 protruding into the mating room 400 and installing in symmetrical and resisting an outer shell of the corresponded connector. The rear portion 44 and the main body 43 form a step structure.

Referring to FIGS. 1 to 5 and FIG. 8, the sealer 5 includes a circle groove 54 puncturing an inner surface 53 of the sealer 5 and an inclining portion 55 located at a front end of the inner surface 53.

There exists a filling groove 45 between the circle channel 17 and an inner surface of the shielding shell 4. The electrical connector 100 further includes a waterproof board 6 filling the filling groove 45 to seal up gaps between the insulative housing 1 and the shielding shell 4.

During the process of making the electrical connector 100 in the first embodiment, first step: insert-molding the upper terminals 21 with the upper module 14 and insert-molding the lower terminals 22 with the lower module 15. The contacting portions 23 of the upper terminals 21 are exposed to an upper surface of the first tongue portion 142. The soldering portions 24 protrude from a rear end of the first base portion 141 and extend rearward. The fixing portions 25 of the upper terminals 21 are fixed to the first base portion 141. Second step: assembling the shielding plate 3 sandwiched between the upper module 14 retaining the upper terminals 21 and the lower module 15 retaining the lower terminals 22 along a vertical direction. Fix the main portion 31 and the board portion 32 to the insulative housing 1 between the first tongue portion 142 and the second tongue portion 152. Two sides of the main portion 31 are exposed to a pair of lateral sides of the tongue portion 12. The soldering pins 33 extend from the rear ends of the first base portion 141 and the second base portion 142 and are bent downwardly to connect with the PCB. The shielding plate is used to ground to ensure the stability of the signals. The insulator 16 is over-molding with the upper module 14 affixing the upper terminals 21. The lower module 15 is affixed to the lower terminals 22 to form an insulative module. The insulative module includes a circle ring 17. Third step: Providing a mating room 400 receiving the shielding shell 4 formed by metal injection molding. Forth step: providing a sealer 5, assembling the sealer to the shielding shell 4. Make the sealer 5 cover an outer surface of a front end of the main body 43 and a front edge 47. The sealer 5 has a character of elasticity making the sealer 5 attach to the shielding shell 4 firmly. In other embodiments the sealer 5 is attached to the shielding shell 4 and the electrical device 700 by adhesive to enforcing the fixing force. The sealer 5 is formed by solidification of plastic material. Make the circle convex portion 46 stuck in the circle groove 54. The rear end of the inner surface 53 of the sealer is connected smoothly with the inner surface of the shielding shell 4 so that the corresponded electrical connector slides smoothly into the mating room 400. Make the sealer 5 and the outer surface of the shielding shell form a stepped shape. The rear portion 44 covers the rear end of the base portion 11 partially making a good effect of shielding and preventing the damage of the insulative housing 1. Form a filling groove 45 between the circle channel 17 and the inner surface of the shielding shell 4. Pour the liquid glue in the filling groove 45 and a waterproof board 6 is formed after solidification.

In the third step, the electrical connector 100 is affixed to the electrical device 700. The front end of the sealer 5 is located between the shielding shell 4 and the stepped portion 72. The outer surface of the sealer 5 is attached to the inner surface of the receiving space 73. The front surface of the sealer 5 resists the stepped portion 72 preventing water or other liquid substance going into the electrical device 700 through the gap between the electrical connector 100 and the electrical device. The receiving space 73 of the electrical device 700 resists the sealer 5 in priority making a better effect of waterproof. The tongue portion 12 extends forwardly out of the mating room 400 and stretches into the mating hole 71.

The length of the sealer 5 could be shorter as usual making the front edge 47 in the same plane with the front surface of the sealer 5 along a vertical direction. The front edge 47 and the front surface of the sealer 5 resist against the stepped portion 72. The arrangement could achieve miniaturization.

Referring to FIG. 9, the second embodiment is shown. The electrical connector 100' includes an insulative module and an outer shell enclosing the insulative housing. The insulative module includes an insulative housing 1', a number of upper terminals 21' and lower terminals 22' and a shielding plate 3'. The insulative housing 1' includes a base portion 11' and a tongue portion 12' extending forwardly from the base portion 11'. The base portion 11' includes a circle channel 17'. In the second embodiment, the outer shell is a shielding shell 4' not including a sealer 5. The shielding shell 4' in the second embodiment is as same as the shielding shell 4 in the first embodiment except the circle convex portion 46. The shielding shell 4' defines a mating room 400'. The circle channel 17' forms a filling groove 45' with an inner surface of the shielding shell 4' therebetween. The liquid glue is poured in the filling groove 45' and forms a waterproof board 6' after solidification.

The differences of making method between the first embodiment and the second embodiment are that the outer shell in the second embodiment is only a shielding shell 4' without a sealer 5. The shielding shell 4' has no circle convex portion 46.

Figure 8:
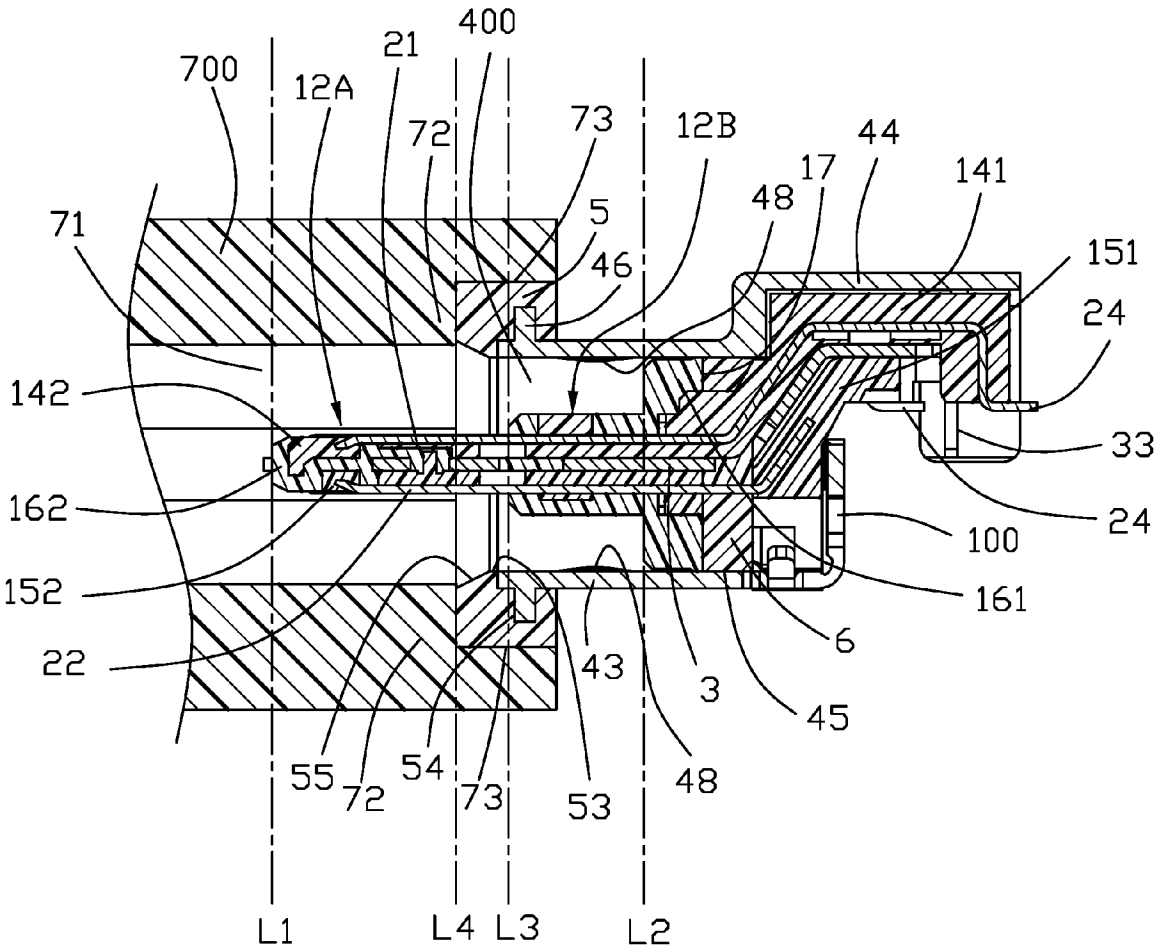
FIG. 8 is a cross-sectional view of the electrical connector mounting to an outer shell of an electrical device in the first embodiment.
Figure 9:
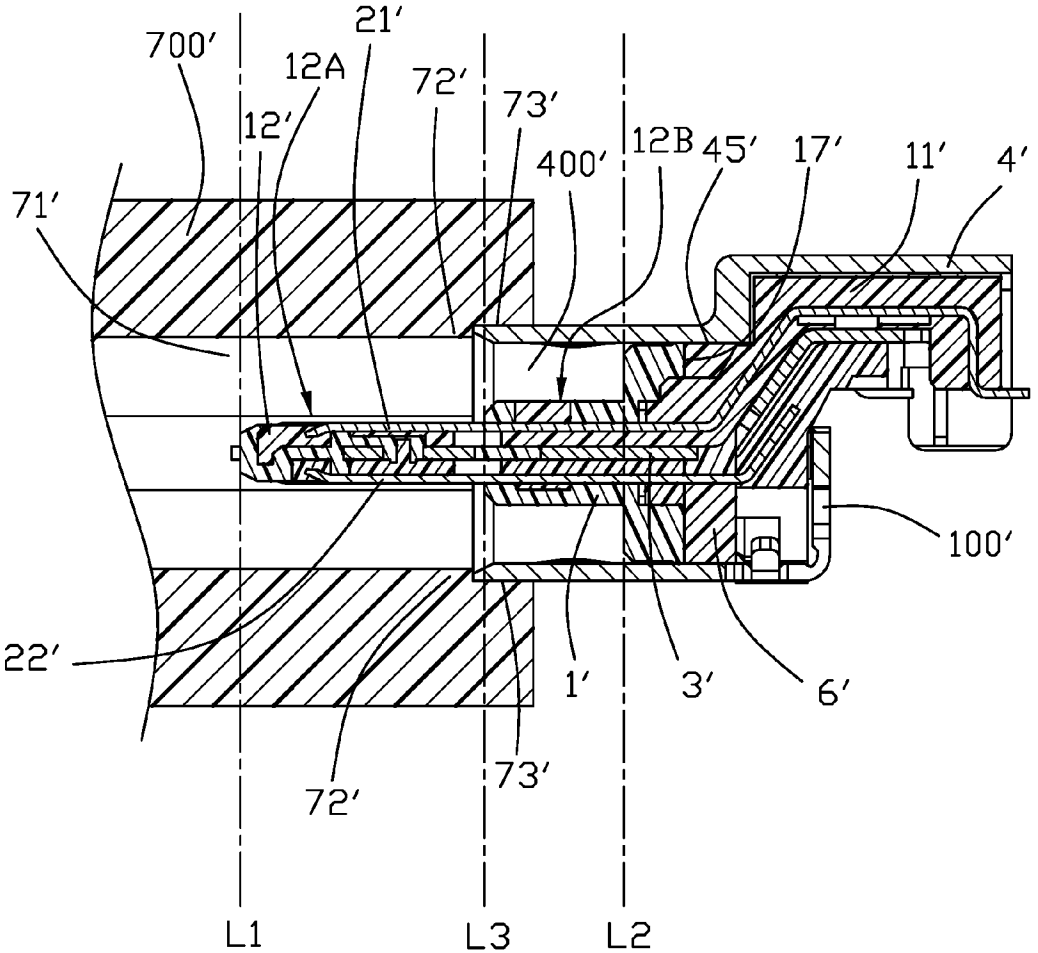
FIG. 9 is a cross-sectional view of the electrical connector mounting to an outer shell of an electrical device in a second embodiment.

Referring to FIGS. 8 to 9, the mating hole 71(71') penetrates the mating room 400(400'). The tongue portion 12(12') in the first embodiment and the second embodiment extends partially out of the mating room 400(400') and stretches into the mating hole 71(71'). The arrangements could achieve the miniaturization of the electrical connector 100(100'). When the electrical connectors 100(100') are installed in the electronic devices 700(700'), the length occupied in the insertion direction is shortened to facilitate the layout and installation of the other parts, thereby facilitating miniaturization and thinning of the electronic device.

Compared with prior arts, the electrical connector 100 (100') has better effects as follows. The outer shell includes the shielding shell 4 and the sealer 5. The circle convex portion 46 of the shielding shell 4 is inserted into the circle groove 54 of the sealer 5 enhancing the force between the shielding shell 4 and the waterproof 5 for preventing the sealer 5 falling of the shielding shell 4. It is also noted that with reference to FIGS. 8 and 9, in this embodiment the front end of the tongue portion 12 defines a vertical line L1, the rear end of the tongue portion 12, i.e., the boundary between the tongue portion 12 and the base portion 11, defines a vertical line L2. The tongue portion 12 forms a front thinner section 12A and a rear thicker section 12B with therebetween a boundary defining a vertical line L3 wherein a dimension ratio between the front thinner section 12A and the rear thicker section 12B along the front-to-back direction is around 7:4 roughly following the specification regulated by the related committee standard. Correspondingly, a front end of the shielding shell 4 extends forwardly slightly beyond the vertical line L3 while with referring to FIG. 8, the sealer 5 attached upon the front end of the shielding shell 4 forms a front end face located at a vertical line L4 which essentially divides the whole tongue portion 12 with two equal parts in the front-to-back direction. Anyhow, in the first embodiment shown in FIG. 8, the electronic device 700 should forms a thickness covering the front end of the tongue portion 12 along the front-to-back direction. In other words, the thickness of the electronic device 700 is expected not to be less than 9/11 of the whole tongue portion 12. With this arrangement, the tongue portion 12 could be efficiently protected in the mating hole 71. Similarly, in the second embodiment shown in FIG. 9, the thickness of the electronic device 700' is expected not to be less than 9/11 of the whole tongue portion 12 for efficiently protecting the tongue portion 12' in the mating hole 71'.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector for mounting to an electrical device which has a mating hole and a stepped portion located at a rear end of the mating hole to form a receiving space therebetween, the electrical connector comprising:

an insulative housing having a base portion and a tongue portion extending forwardly from the base portion;

a plurality of conductive contacts affixed to the insulative housing;

a shielding plate affixed to the insulative housing;

a shell attached to the insulative housing to form a mating room and adapted for assembling to the receiving space; and a sealer enclosing a front end of the shell and adapted for resisting against the stepped portion; wherein the tongue portion extends out of the mating room and stretches into the mating hole.

2. The electrical connector as claimed in claim 1, wherein the shell comprises a shielding shell extending forwardly for resisting against the stepped portion.

3. The electrical connector as claimed in claim 2, wherein the shielding shell comprises a plurality of tubers protruding into the mating room and arranged in symmetry.

4. The electrical connector as claimed in claim 1, wherein the sealer comprises an outer surface adapted for attaching to the inner surface of the receiving space and a front surface for resisting against the stepped portion, and the sealer is located at an outer surface of the front end of the shielding shell.

5. The electrical connector as claimed in claim 4, wherein the sealer is assembled to the outer surface of the front end of the shielding shell.

6. The electrical connector as claimed in claim 4, wherein the sealer is insert-molded with the outer surface of the front end of the shielding shell.

7. The electrical connector as claimed in claim 4, wherein the shielding shell is formed by metal injection molding, the shielding shell including a circle convex portion surrounding the outer surface of the front end of the shielding shell, and the sealer comprises at an inner surface thereof an annular groove engaging the circle convex portion.

8. The electrical connector as claimed in claim 4, wherein the sealer comprises an inclining portion located at a front end of an inner surface thereof, and an inner surface of the shielding shell is aligned with a rear of the inner surface of the sealer.

9. An electrical connector assembly comprising:

an electronic device having a wall defining a mating hole communicating with an exterior along a front-to-back direction and surrounded by a step portion which defines a receiving space around an interior face therein;

an electrical connector including:

an insulative housing having a tongue portion forwardly extending from a base portion in said front-to-back direction, said tongue portion having a front thinner section and a rear thicker section with a ratio of 7:4 therebetween;

a plurality of contacts disposed in the housing;

a metallic shielding plate embedded within the housing;

a metallic shielding shell enclosing the housing and cooperating with the housing to define a mating room therebetween; and a front end of the shielding shell terminated slightly in front of a boundary between the front thinner section and the rear thicker section in the front-to-back direction, and generally positioned around the receiving space adjacent to the step portion; wherein a thickness of the wall is not less than 9/11 of the whole tongue portion in the front-to-back direction so as to have said mating hole large enough along the front-to-back direction to efficiently protectively receive the front thinner section therein.

10. The electrical connector assembly as claimed in claim 9, wherein an insulative sealer is attached upon the front end of the shielding shell and snugly received in the receiving space and forwardly abutting against the step portion.

11. The electrical connector assembly as claimed in claim 10, wherein said shielding shell forms a circumferential outward protrusion embedded in the sealer.

12. The electrical connector assembly as claimed in claim 10, wherein said sealer forms an inclined portion interfaced between the mating hole and the mating room in the front-to-back direction.

13. The electrical connector assembly as claimed in claim 12, wherein the mating hole is larger than the mating room compared with corresponding vertical cross-sectional planes along the front-to-back direction.

14. An electrical connector assembly comprising:

an electronic device having a wall defining a mating hole communicating with an exterior along a front-to-back direction and surrounded by a step portion which defines a receiving space around an interior face therein;

an electrical connector including:

an insulative housing having a tongue portion forwardly extending from a base portion in said front-to-back direction, said tongue portion having a front thinner section and a rear thicker section with a ratio of 7:4 therebetween;

a plurality of contacts disposed in the housing;

a metallic shielding plate embedded within the housing;

a metallic shielding shell enclosing the housing and cooperating with the housing to define a mating room therebetween; and a front end of the shielding shell terminated slightly in front of a boundary between the front thinner section and the rear thicker section in the front-to-back direction, and generally positioned around the receiving space adjacent to the step portion; wherein a sealer is attached to said front end of the shielding shell and received in the receiving space and abutting against the step portion in the front-to-back direction; wherein the front thinner section extends forwardly beyond a front end face of the sealer.

15. The electrical connector assembly as claimed in claim 14, wherein in a top view, the front end face of the sealer corresponds to a mid point of the whole tongue portion along the front-to-back direction.

16. The electrical connector assembly as claimed in claim 15, wherein said sealer further forms an inclined portion interfaces between the mating hole and the mating room in the front-to-back direction.

17. The electrical connector assembly as claimed in claim 14, wherein the mating hole is larger than the mating room compared with corresponding vertical cross-sectional planes along the front-to-back direction.

* * * * *